US008453728B2

(12) United States Patent
Heburn

(10) Patent No.: US 8,453,728 B2
(45) Date of Patent: Jun. 4, 2013

(54) APPARATUS AND METHOD FOR DEPTH REFERENCING DOWNHOLE TUBULAR STRINGS

(75) Inventor: Neil Heburn, Ponteland (GB)

(73) Assignee: Halliburton Energy Services, Inc., Houston, TX (US)

( * ) Notice: Subject to any disclaimer, the term of this patent is extended or adjusted under 35 U.S.C. 154(b) by 370 days.

(21) Appl. No.: 12/843,981

(22) Filed: Jul. 27, 2010

(65) Prior Publication Data

US 2012/0024544 A1 Feb. 2, 2012

(51) Int. Cl.
*E21B 19/16* (2006.01)
*E21B 17/08* (2006.01)

(52) U.S. Cl.
USPC ..... 166/208; 166/382; 166/255.1; 166/242.1; 166/113

(58) Field of Classification Search
USPC ..... 166/385, 214, 208, 206, 382, 255.1, 166/242.1, 237, 64, 113
See application file for complete search history.

(56) References Cited

U.S. PATENT DOCUMENTS 2,673,614 A * 3/1954 Miller ..... 166/214
3,344,862 A * 10/1967 Conrad ..... 166/216
3,356,144 A * 12/1967 Berry ..... 166/208
3,381,750 A * 5/1968 Brown ..... 166/64
3,802,506 A * 4/1974 Young ..... 166/136
3,804,165 A * 4/1974 Meripol ..... 166/206
4,126,179 A * 11/1978 Long ..... 166/64
5,620,052 A * 4/1997 Turner ..... 166/348
7,013,997 B2 3/2006 Vail, III
7,284,606 B2 * 10/2007 Coronado ..... 166/255.1
7,540,329 B2 6/2009 Fay et al.
7,874,351 B2 1/2011 Hampton et al.
2011/0315400 A1 * 12/2011 Zweifel ..... 166/382

FOREIGN PATENT DOCUMENTS

SU 855192 B * 8/1981

* cited by examiner

*Primary Examiner* — Kenneth L Thompson
(74) *Attorney, Agent, or Firm* — Lawrence R. Youst

(57) ABSTRACT

An apparatus (100) for depth referencing tubular strings in a wellbore. The apparatus (100) includes a depth reference coupling (102) having a profile (112) that is positioned in a first tubular string. The first tubular string has a predetermined length between the depth reference coupling (102) and a predetermined reference point. The apparatus (100) also includes an indicator assembly (118) having a mating profile (128) operable to engage the profile (112) of the depth reference coupling (102) that is positioned in a second tubular string. In operation, the second tubular string is run in the first tubular string until the mating profile (128) of the indicator assembly (118) engages the profile (112) of the depth reference coupling (102), thereby enabling reliable depth referencing of the tubular strings.

13 Claims, 6 Drawing Sheets

APPARATUS AND METHOD FOR DEPTH REFERENCING DOWNHOLE TUBULAR STRINGS

TECHNICAL FIELD OF THE INVENTION

This invention relates, in general, to equipment utilized in conjunction with operations performed in relation to subterranean wells and, in particular, to an apparatus and method for depth referencing downhole tubular strings.

BACKGROUND OF THE INVENTION

Without limiting the scope of the present invention, its background will be described in relation to subsea well construction, as an example.

In constructing subsea wells, numerous tubular stings as well as other tools and equipment are installed within the well. Depth control and knowing the exact space-out of these tubulars, tools and equipment in the well is highly desirable for successfully and efficiently completing the well. It has been found, however, that in many subsea applications where the drilling rig is subject to heave due to the prevailing sea state and conditions, achieving the desired depth control and space-out is a considerable challenge.

In subsea applications, the subsea wellhead is typically the fixed reference point for all downhole operations. While the various casing strings may each extend from the wellhead, many wells are constructed using one or more liners strings, which are casing strings that do not extend to the wellhead, but instead are anchored or suspended from inside the bottom of the previous casing string. Typically, such liner strings are suspended within the previous casing using a liner hanger, screen hangers or similar packer type devices. Due to wave motion, the drilling rig is constantly moving up and down relative to the wellhead. In conventional practice, this motion has limited the precision with which a liner string can been located and anchored in a previous casing. Thereafter, since neither the liner string nor the liner hanger is depth referenced to the subsea wellhead, there is uncertainty regarding the exact depth of these components as well as any additional liner string, tools or equipment subsequently installed within such a liner string.

Therefore, a need has arisen for an apparatus and method that will enable reliable depth referencing of tubular strings in subsea well installations. A need has also arisen for such an apparatus and method that can overcome the constant up and down movement of the drilling rig relative to the wellhead during subsea well installations. Further, need has arisen for such an apparatus and method that can reduce the uncertainty regarding the depth of liner strings, tools or other equipment subsequently installed within a previous liner string.

SUMMARY OF THE INVENTION

The present invention disclosed herein is directed to an apparatus and method for depth referencing downhole tubular strings. The apparatus and method of the present invention are operable to overcome the constant up and down movement of the drilling rig relative to the wellhead during subsea well installations. In addition, the apparatus and method of the present invention are operable to reduce the uncertainty regarding the depth of liner strings, tools or other equipment subsequently installed within a depth referenced liner string.

In one aspect, the present invention is directed to an apparatus for depth referencing tubular strings in a wellbore. The apparatus includes a depth reference coupling positioned in a first tubular string. The first tubular string has a predetermined length between the depth reference coupling and a predetermined reference point. The depth reference coupling has a profile. The apparatus also includes an indicator assembly positioned in a second tubular string. The indicator assembly has a mating profile operable to engage the profile of the depth reference coupling. In operation, the second tubular string is run in the first tubular string until the mating profile of the indicator assembly engages the profile of the depth reference coupling, thereby establishing reliable depth referencing of the tubular strings.

In one embodiment, the depth reference coupling is operable to connect two adjacent tubular members of the first tubular string. In another embodiment, the profile of the depth reference coupling includes at least one circumferential recess disposed in an inner surface of thereof. In a further embodiment, the profile of the depth reference coupling includes multiple circumferential recesses disposed in an inner surface of thereof.

In one embodiment, the indicator assembly is in the form of an indicator coupling that is operable to connect two adjacent tubular members of the second tubular string. In another embodiment, the mating profile of the indicator assembly includes a plurality of locating keys. In a further embodiment, the mating profile of the indicator assembly includes a collet assembly.

In another aspect, the present invention is directed to a system for depth referencing and installing tubular strings in a wellbore. The system includes a depth reference coupling positioned in a first tubular string installed in the wellbore. The first tubular string has a predetermined length between the depth reference coupling and a predetermined reference point. The depth reference coupling has a profile. An indicator assembly is positioned in a second tubular string. The indicator assembly has a mating profile operable to engage the profile of the depth reference coupling. A service string assembly that is releasably engageable with the second tubular string is operable to run the second tubular string in the first tubular string until the mating profile of the indicator assembly engages the profile of the depth reference coupling. A suspension tool positioned in the second tubular string is selectively operable to support the second tubular string within the first tubular string.

In one embodiment, the indicator assembly is positioned downhole of the suspension tool in the second tubular string. In another embodiment, the indicator assembly is positioned uphole of the suspension tool in the second tubular string. In this embodiment, the indicator assembly may be retrievable to the surface with the service string assembly once the suspension tool has been actuated.

In a further aspect, the present invention is directed to method for depth referencing tubular strings in a wellbore. The method includes installing a first tubular string in the wellbore, the first tubular string having a depth reference coupling positioned therein, the depth reference coupling having a profile; determining the depth of the depth reference coupling relative to a predetermined reference point; running a second tubular string in the first tubular string, the second tubular string having an indicator assembly positioned therein, the indicator assembly having a mating profile; and engaging the mating profile of the indicator assembly with the profile of the depth reference coupling.

The method may also include connecting two adjacent tubular members of the first tubular string with the depth reference coupling, determining the depth of the depth reference coupling relative to a wellhead reference point, determining the depth of the depth reference coupling relative to a reference point in a third tubular string, connecting two adjacent tubular members of the second tubular string with the indicator assembly, engaging a plurality of locating keys of the indicator assembly with the profile of the depth reference coupling or engaging a collet assembly of the indicator assembly with the profile of the depth reference coupling.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
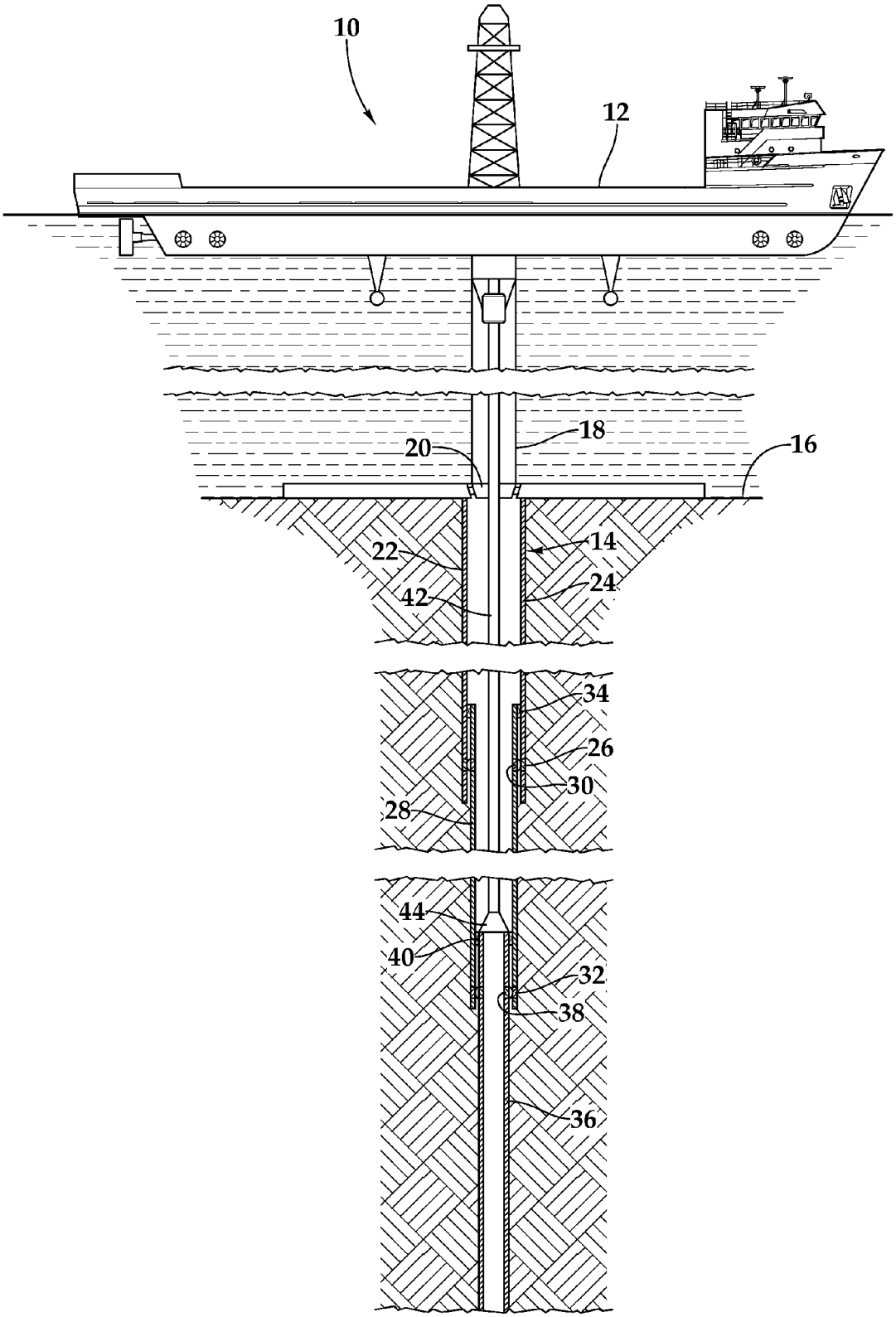
FIG. 1 is a schematic illustration of a subsea drilling and production facility positioned above a subsea well operating depth referencing assemblies according to an embodiment of the present invention.

Referring initially to FIG. 1, a subsea well is being constructed utilizing the apparatus, system and method of the present invention for depth referencing tubular string that is schematically illustrated and generally designated 10. A floating oil and gas drilling and production platform facility 12 is positioned over a subsea well 14 below seafloor 16. A subsea conduit 18 extends from floating facility 12 to a subsea well installation 20.

The well penetrates the various earth strata to form wellbore 22. Disposed within wellbore 22 is a casing string 24, such as a conductor casing, which is preferably cemented within wellbore 22. Casing string 24 is typically formed from a plurality of steel pipes that are male threaded on each end and connected with short lengths of double-female threaded pipe called couplings. In the illustrated embodiment, only the special coupling of the present invention is depicted separately from casing string 24. Specifically, a depth reference coupling 26 forms a portion of casing string 24 connecting two adjacent casing members together.

Partially disposed within and extending beyond casing string 24 is a casing string 28, such as an intermediate casing, which is preferably cemented within wellbore 22 and constructed of a plurality of male threaded steel pipes connected with double-female threaded couplings therebetween. In the illustrated embodiment, only the special couplings of the present invention are depicted separately from casing string 28. Specifically, an indicator assembly depicted as indicator coupling 30 connects two adjacent casing members together and a depth reference coupling 32 connects two adjacent casing members together. Alternatively, the indicator assembly could be in the form of a sleeve or mandrel positioned in a known location externally of casing string 28 without providing the coupling function. In the illustrated embodiment, casing string 28 is supported within casing string 24 by a suspension tool 34 which may be a liner hanger, a screen hanger, a packer type device or other suitable sealing and anchoring assembly.

Currently being installed within and extending beyond casing string 28 is a casing string 36, such as a production casing, which is preferably cemented within wellbore 22 and constructed of a plurality of male threaded steel pipes connected with double-female threaded couplings therebetween. In the illustrated embodiment, only the special coupling of the present invention is depicted separately from casing string 36. Specifically, an indicator assembly depicted as indicator coupling 38 connecting two adjacent casing members together. Casing string 36 includes a suspension tool 40 that will support casing string 36 within casing string 28 upon actuation. In the illustrated embodiment, casing string 36 has been run downhole on the end of a work string or service string 42. A service string assembly 44 releasably couples service string 42 to casing string 36.

Preferably, casing string 24 is connected with subsea well installation 20 via a portion of the wellhead known as a casing hanger (not pictured). The location of the casing hanger is known. Likewise, the distance casing string 24 extends downwardly into wellbore 22, the casing string length, is also known. Depth referencing of any location within casing string 24 can thus be accomplished relative to the known and fixed position of the wellhead. As such, the location of depth referencing coupling 26 in the wellbore can be precisely determined relative to the wellhead.

As illustrated, casing string 28 has been installed within casing string 24. During the installation process, casing string 24 is run in the well on a conveyance such as service string 42 until indicator coupling 30 of casing string 28 engages with depth reference coupling 26 of casing string 24. Preferably, the engagement of indicator coupling 30 and depth reference coupling 26 is mechanical in nature using, for example, a collet assembly, locating keys or the like, as discussed below, which triggers a liner running weight response at the surface when interaction occurs. For example, depending on the design of indicator coupling 30 and depth reference coupling 26 an increase of 20,000 pounds or more in liner running weight could be used as the signal that indicator coupling 30 and depth reference coupling 26 have engaged. Thereafter, suspension tool 34 is actuated to sealably and grippingly secure casing string 28 within casing string 24.

The location of depth referencing coupling 26 is known and thus the location of indicator coupling 30 is known. Likewise, the length of casing string 28 is known. Depth referencing of any location within casing string 28 can thus be accomplished relative to the known and fixed position of the wellhead. As such, the location of depth referencing coupling 32 in the wellbore can be precisely determined relative to the wellhead.

As further illustrated, casing string 36 is being installed within casing string 28. During this process, casing string 36 is run in the well on service string 42 until indicator coupling 38 of casing string 36 engages with depth reference coupling 32 of casing string 28. Preferably, the engagement of indicator coupling 38 and depth reference coupling 32 triggers a liner running weight response at the surface when interaction occurs. Thereafter, suspension tool 40 may be actuated to sealably and grippingly secure casing string 36 within casing string 28. The location of depth referencing coupling 32 is known and thus the location of indicator coupling 38 is known. Likewise, the length of casing string 36 is known. Depth referencing of any location within casing string 36 can thus be accomplished relative to the known and fixed position of the wellhead.

Even though FIG. 1 depicts a well having three casing strings, it should be understood by those skilled in the art that any number of casing strings may be deployed within a well without departing from the principles of the present invention. In addition, even though FIG. 1 depicts an offshore well environment, it should be understood by those skilled in the art that the apparatuses, systems and methods of the present invention are equally well suited for use in association with onshore well operations. Further, even though FIG. 1 depicts a vertical well, it should be understood by those skilled in the art that the apparatuses, systems and methods of the present invention are equally well suited for use in well having other directional configurations including horizontal wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
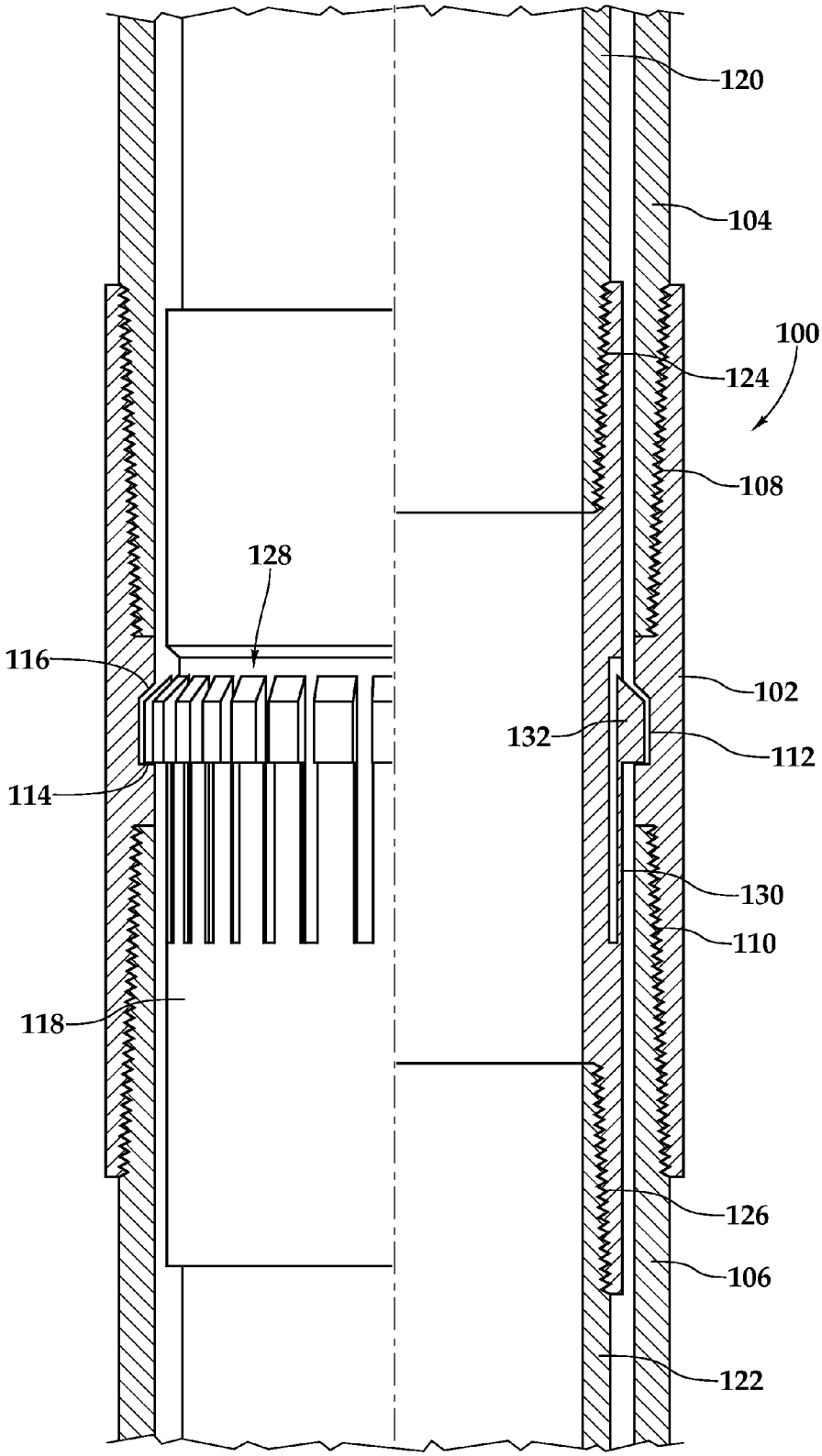
FIG. 2 is a cross sectional view, partially in quarter section, of a depth referencing assembly according to an embodiment of the present invention.

Referring next to FIG. 2, one embodiment of a depth referencing assembly is depicted and generally designated 100. Depth referencing assembly 100 includes a depth reference coupling 102 that connects or joins tubular member 104 and tubular member 106 through threaded connections 108 and 110, respectively. Additionally, depth reference coupling 102 includes an internal profile depicted as a circumferential slot or recess 112 that is disposed substantially within or about the inner surface of depth reference coupling 102. Recess 112 preferably has a square lower surface 114 and an inclined or ramped upper surface 116 that provide a predetermined resistance to the movement of a matching profile received therein, as explained below.

Depth referencing assembly 100 further includes an indicator assembly depicted as indicator coupling 118 that connects or joins tubular member 120 and tubular member 122 through threaded connections 124 and 126, respectively. Indicator coupling 118 includes a mating profile depicted as collet assembly 128, which has a plurality of collet fingers 130 that are circumferentially disposed about the outer surface thereof. Each of the collet fingers 130 include a head or protrusion 132 that is shaped and sized to engage with recess 112. Although a particular number of collet fingers 130 are shown, indicator coupling 118 may include a greater or lesser number of collet fingers 130. Also, even though collet assembly 128 is depicted as having collet fingers 130 with a single head 132 at the ends thereof, it should be understood by those skilled in the art that the collet fingers could alternatively have protrusions at other axial locations along the length of the collet fingers or could have multiple protrusions along the length of the collet fingers including or excluding the end of the collet fingers so long as the mating profile of the collet assembly matches or is able to engage with the profile of the corresponding depth reference coupling.

As illustrated, collet fingers 130 are preferably retractable, such that they may be positioned or biased inwardly when run into position and then extend outwardly to engage with recess 112. Preferably, recess 112 is formed in the inner surface or wall of depth reference coupling 102 such that it provides a unique profile or shape for engaging a particular mating profile of indicator coupling 118. For example, lower surface 114 of recess 112 has a substantially square shoulder to engage a similarly shaped square surface or portion of protrusions 132 to enable a significant liner running weight response to be registered. Likewise, upper surface 116 of recess 112 is inclined or ramped to engage a similarly shaped ramped side or portion of protrusions 132 to enable collet fingers 130 to be disengaged from recess 112 thereby enabling an upward movement of the inner tubular string relative to the outer tubular string if desired.

As discussed above, depth reference coupling 102 and tubular members 104, 106 are preferably part of an outer casing string, such as casing string 24. Likewise, indicator coupling 118 and tubular members 120, 122 are preferably part of an inner casing string, such as casing string 28. In this example, the outer casing string will have an upper end that is engaged or supported by an assembly or apparatus, such as subsea well installation 20 having a known or fixed position. The length of the outer casing string between the upper supported end and the location of depth reference coupling 102 is predetermined and known, thus enabling depth referencing with the upper supported end. Once indicator coupling 118 has engaged with depth reference coupling 102, the location of indicator coupling 118 is now known. Additionally, the length of the inner casing string between indicator coupling 118 and it lower end is predetermined or known, thereby providing reliable depth referencing to any location along the length of the combined casing system. As discussed above, the inner casing string could also utilize a depth reference coupling proximate its lower end such that another inner casing string could be installed therein and depth referenced to a known and fixed location.

Figure 3:
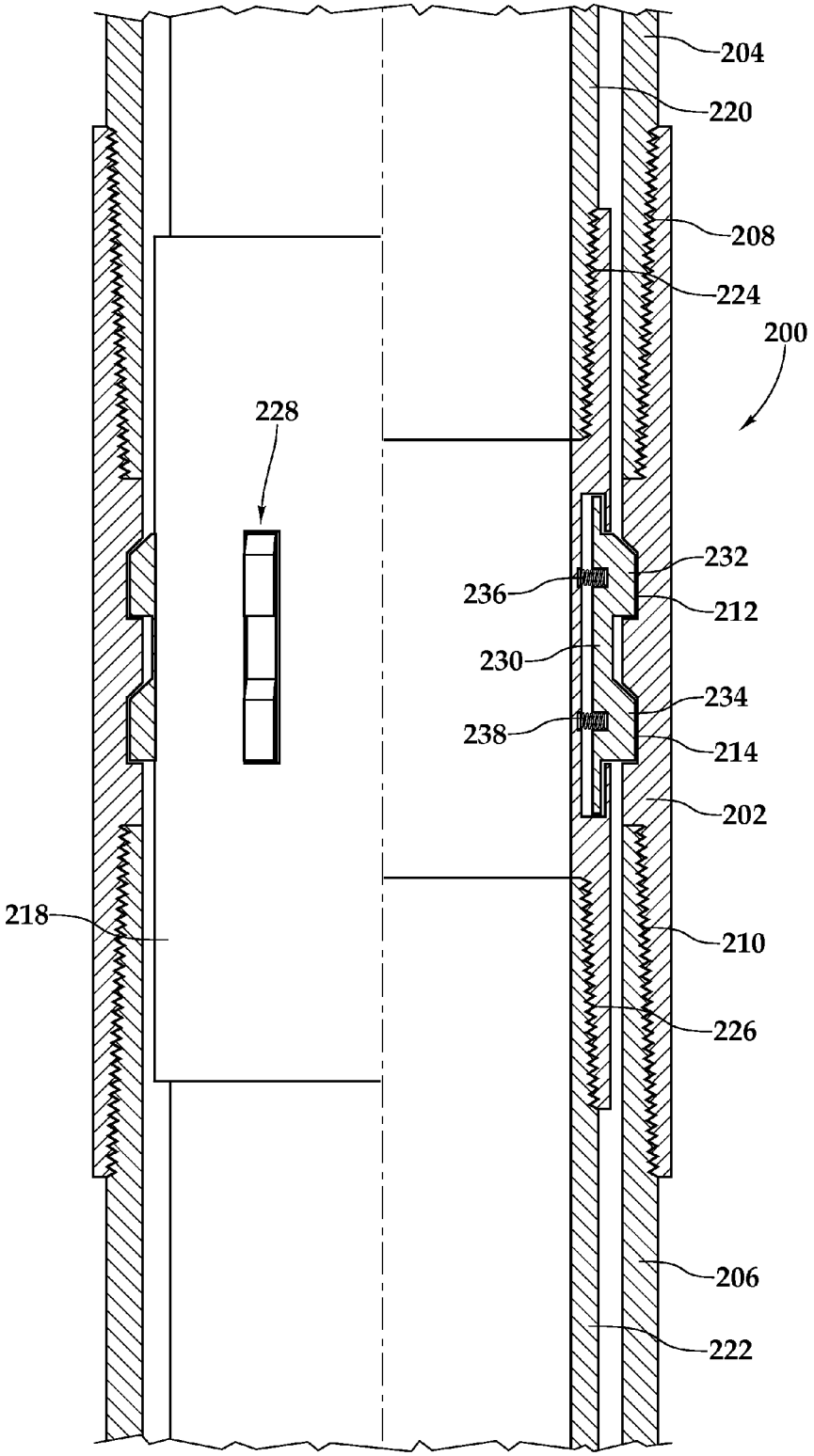
FIG. 3 is a cross sectional view, partially in quarter section, of a depth referencing assembly according to an embodiment of the present invention.

Referring next to FIG. 3, one embodiment of a depth referencing assembly is depicted and generally designated 200. Depth referencing assembly 200 includes a depth reference coupling 202 that connects or joins tubular member 204 and tubular member 206 through threaded connections 208 and 210, respectively. Additionally, depth reference coupling 202 includes an internal profile depicted as a pair of circumferential slots or recesses 212, 214 that are disposed substantially within or about the inner surface of depth reference coupling 202. In the illustrated embodiment, recess 212, 214 each have square lower surfaces and inclined or ramped upper surfaces that provide a predetermined resistance to the movement of a matching profile received therein, as explained below.

Depth referencing assembly 200 further includes an indicator assembly depicted as indicator coupling 218 that connects or joins tubular member 220 and tubular member 222 through threaded connections 224 and 226, respectively. Indicator coupling 218 includes a mating profile depicted as latch assembly 228, which has a plurality of locating keys 230 that are circumferentially disposed about the outer surface thereof. Each of the locating keys 230 include a pair of protrusions 232, 234 that are shaped and sized to engage with recesses 212, 214 of depth reference coupling 202. Although a particular number of locating keys 230 are shown, indicator coupling 218 may include a greater or lesser number of locating keys 230. Also, even though latch assembly 228 is depicted as having locating keys 230 with a pair of protrusions 232, 234, it should be understood by those skilled in the art that the locating keys could alternatively have any type or design of mating profile so long as it matches or is able to engage with the profile of the corresponding depth reference coupling.

As illustrated, locating keys 230 are preferably retractable, such that they may be positioned or biased inwardly when run into position and then extend outwardly to engage with recesses 212, 214. In the illustrated embodiment, springs 236, 238 provide the outwardly biasing force. Preferably, recesses 212, 214 are formed in the inner surface or wall of depth reference coupling 202 and provide a unique profile or shape for engaging a particular mating profile of indicator coupling 218. For example, the lower surfaces of recesses 212, 214 have a substantially square shoulder to engage a similarly shaped square surface or portion of protrusions 232, 234 to enable a significant liner running weight response to be registered. Likewise, the upper surfaces of recesses 212, 214 are inclined or ramped to engage a similarly shaped ramped side or portion of protrusions 232, 234 to enable locating keys 230 to be disengaged from recesses 212, 214 thereby enabling an upward movement of the inner tubular string relative to the outer tubular string if desired.

As discussed above, depth reference coupling 202 and tubular members 204, 206 are preferably part of an outer casing string, such as casing string 24. Likewise, indicator coupling 218 and tubular members 220, 222 are preferably part of an inner casing string, such as casing string 28. In this example, the outer casing string will have an upper end that is engaged or supported to an assembly or apparatus, such as subsea well installation 20 having a known or fixed position. The length of the outer casing string between the upper supported end and the location of depth reference coupling 202 is predetermined and known, thus enabling depth referencing with the upper supported end. Once indicator coupling 218 has engaged with depth reference coupling 202, the location of indicator coupling 218 is now known. Additionally, the length of the inner casing string between indicator coupling 218 and it lower end is predetermined or known, thereby providing reliable depth referencing to any location along the length of the combined casing system. As discussed above, the inner casing string could also utilize a depth reference coupling proximate its lower end such that another inner casing string could be installed therein and depth referenced to a known and fixed location.

Figure 4:
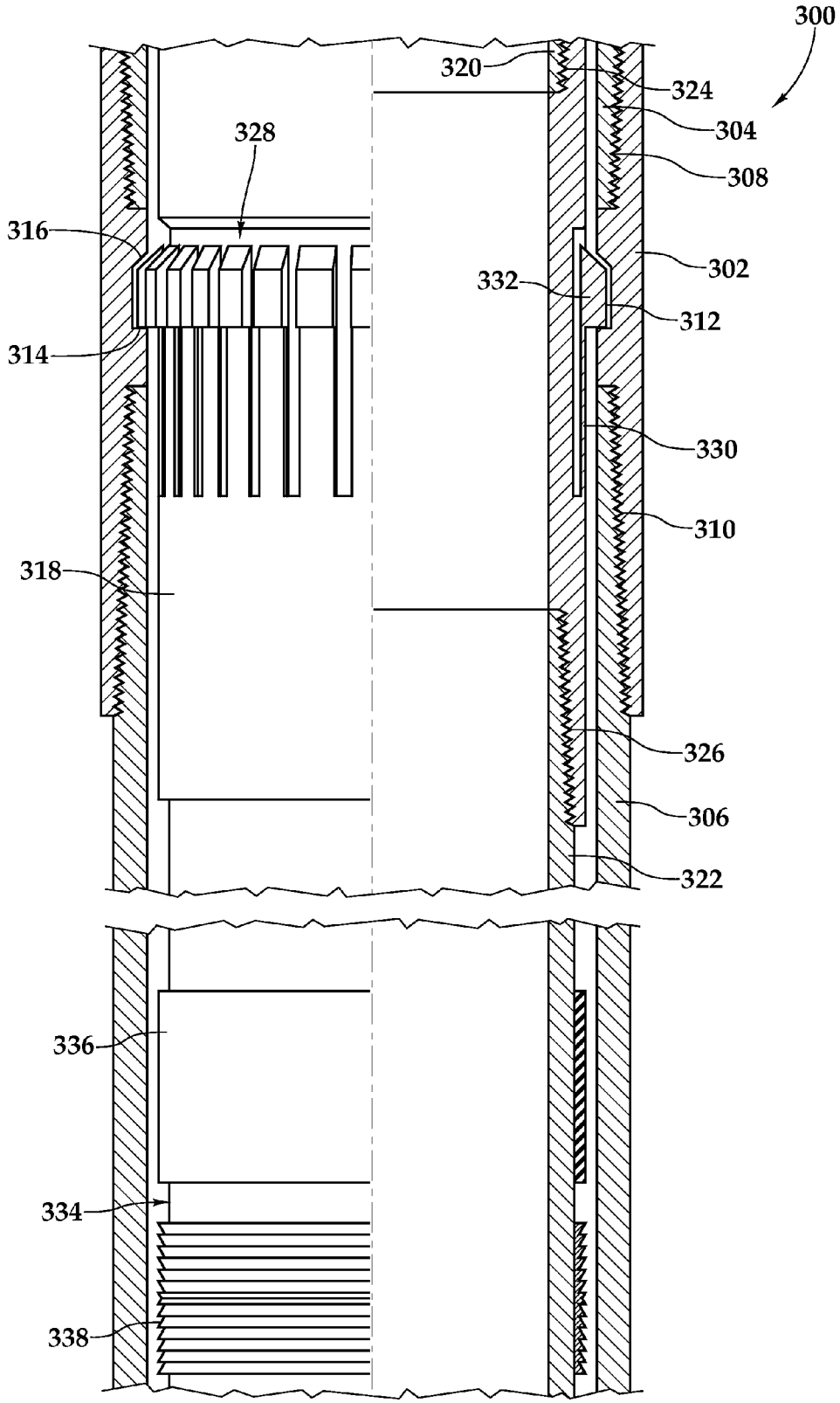
FIG. 4 is a cross sectional view, partially in quarter section, of a depth referencing assembly according to an embodiment of the present invention.

Referring next to FIG. 4, one embodiment of a depth referencing assembly is depicted and generally designated 300. Depth referencing assembly 300 includes a depth reference coupling 302 that connects or joins tubular member 304 and tubular member 306 through threaded connections 308 and 310, respectively. Additionally, depth reference coupling 302 includes an internal profile depicted as a circumferential slot or recess 312 that is disposed substantially within or about the inner surface of depth reference coupling 302. Recess 312 preferably has a square lower surface 314 and an inclined or ramped upper surface 316 that provide a predetermined resistance to the movement of a matching profile received therein, as explained below.

Depth referencing assembly 300 further includes an indicator assembly depicted as indicator coupling 318 that connects or joins tubular member 320 and tubular member 322 through threaded connections 324 and 326, respectively. Indicator coupling 318 includes a mating profile depicted as collet assembly 328, which has a plurality of collet fingers 330 that are circumferentially disposed about the outer surface thereof. Each of the collet fingers 330 include a head or protrusion 332 that is shaped and sized to engage with recess 312. As illustrated, collet fingers 330 are preferably retractable, such that they may be positioned or biased inwardly when run into position and then extend outwardly to engage with recess 312. Preferably, recess 312 is formed in the inner surface or wall of depth reference coupling 302 such that it provides a unique profile or shape for engaging a particular mating profile of indicator coupling 318.

As discussed above, depth reference coupling 302 and tubular members 304, 306 are preferably part of an outer casing string, such as casing string 24. Likewise, indicator coupling 318 and tubular members 320, 322 are preferably part of an inner casing string, such as casing string 28. Unlike the embodiment of FIG. 1, however, the inner casing string of FIG. 4 includes a suspension tool 334 having one or more sealing elements 336 and one or more gripping elements 338 that is position downhole of indicator coupling 318. In this configuration, once indicator coupling 318 has engaged with depth reference coupling 302 and suspension tool 334 has been actuated, indicator coupling 318 may be removed or retrieved from the well with the conveyance that carried the inner casing string downhole such as the work string or service string 42 discussed above.

Figure 5:
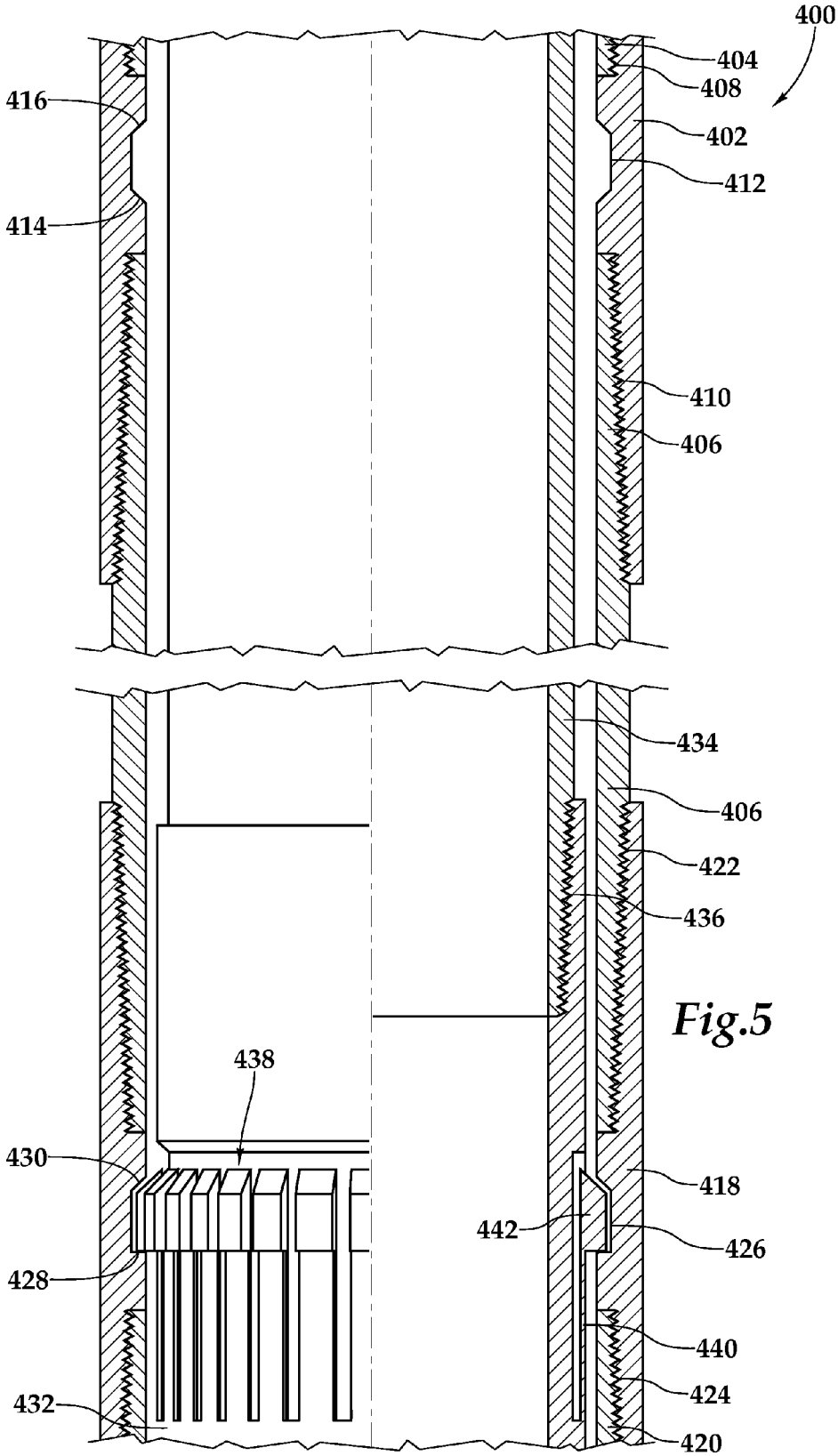
FIG. 5 is a cross sectional view, partially in quarter section, of a depth referencing assembly according to an embodiment of the present invention.

Referring now to FIG. 5, one embodiment of a depth referencing assembly is depicted and generally designated 400. Depth referencing assembly 400 includes a first depth reference coupling 402 that connects or joins tubular member 404 and tubular member 406 through threaded connections 408 and 410, respectively. Additionally, depth reference coupling 402 includes an internal profile depicted as a circumferential slot or recess 412 having a lower surface 414 and an upper surface 416. In this embodiment, lower surface 414 of recess 412 may have a slightly rounded or ramped surface profile for enabling a mating profile to engage with recess 412, but allowing it to pass through recess 412 with suitable force. Such a profile is used as a signal to the operator that the mating profile has encountered recess 412 and that the downward velocity of the tubular string should be slowed for engaging with a second recess as discussed below.

Depth referencing assembly 400 includes a second depth reference coupling 418 that connects or joins tubular member 406 and tubular member 420 through threaded connections 422 and 424, respectively. Additionally, depth reference coupling 418 includes an internal profile depicted as a circumferential slot or recess 426 that is disposed substantially within or about the inner surface of depth reference coupling 418. Recess 426 preferably has a square lower surface 428 and an inclined or ramped upper surface 430 that form sides of recess 426.

Depth referencing assembly 400 further includes an indicator assembly depicted as indicator coupling 432 that connects or joins tubular member 434 through threaded connections 436 and a lower tubular member (not pictured). Indicator coupling 432 includes a mating profile depicted as collet assembly 438, which has a plurality of collet fingers 440 that are circumferentially disposed about the outer surface thereof. Each of the collet fingers 440 include a head or protrusion 442 that is shaped and sized to engage with recesses 412 and 426 of depth reference couplings 402 and 418. As illustrated, collet fingers 440 are preferably retractable, such that they may be positioned or biased inwardly when run into position and then extend outwardly to engage with recesses 412 and 426. In the illustrated embodiment, indicator coupling 432 first engages depth reference coupling 402 which causes a liner running weight response. At this point, the operator has received a signal that indicator coupling 432 is close to its desired depth and additional care may be taken in proceeding downhole. As the lower surface 414 of recess 412 has a ramped surface, it may, for example, require only 10,000 pounds of additional weight to cause indicator coupling 432 to pass through depth reference coupling 402. Shortly thereafter, indicator coupling 432 engages depth reference coupling 418 which causes a liner running weight response. At this point, the operator knows that indicator coupling 432 has reached its desired depth. If any doubt exists regarding proper positioning, the casing string may be lifted such that indicator coupling 432 may again pass through depth reference coupling 402 and reengage with depth reference coupling 418.

Figure 6:
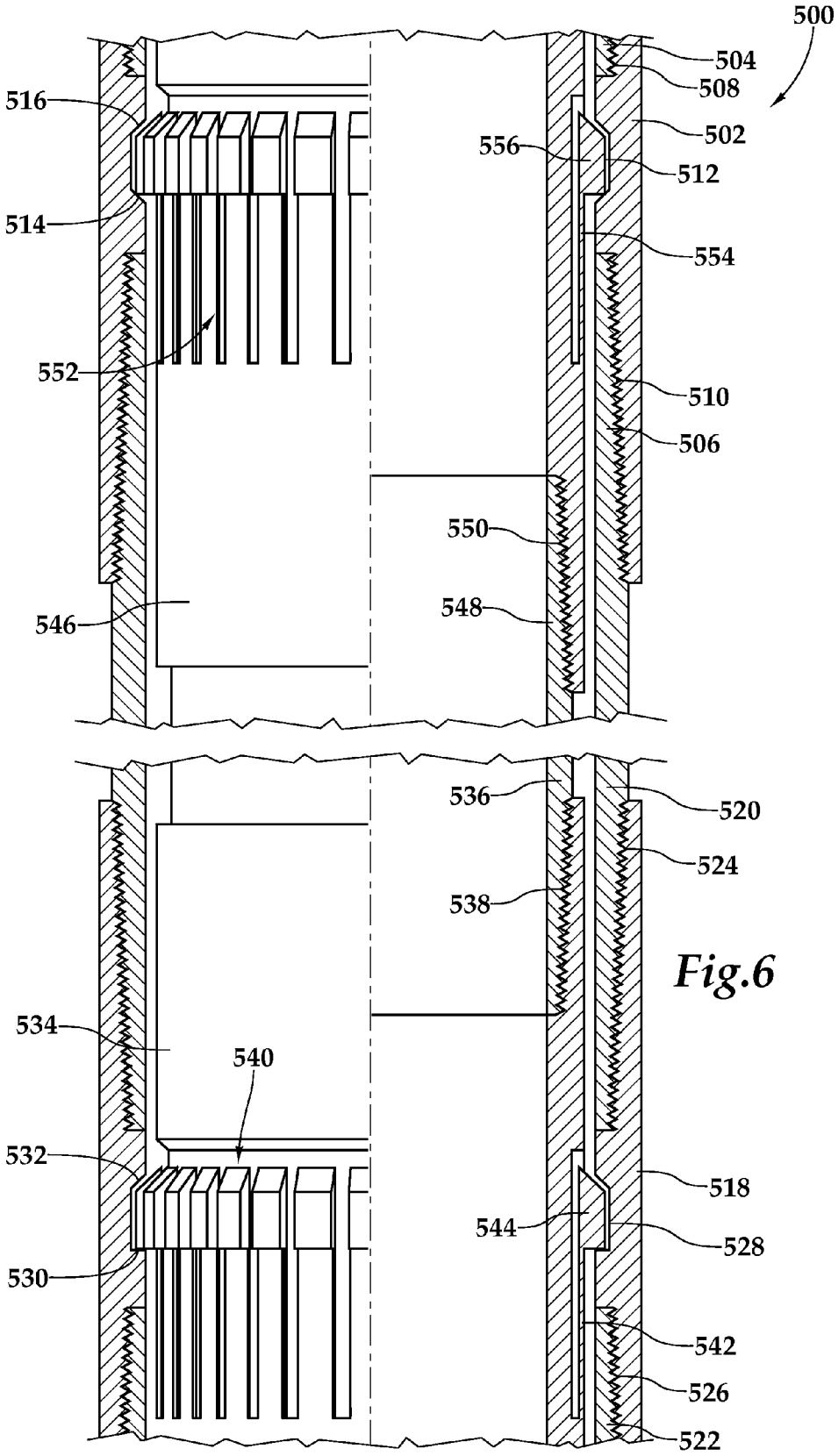
FIG. 6 is a cross sectional view, partially in quarter section, of a depth referencing assembly according to an embodiment of the present invention.

Referring now to FIG. 6, one embodiment of a depth referencing assembly is depicted and generally designated 500. Depth referencing assembly 500 includes a first depth reference coupling 502 that connects or joins tubular member 504 and tubular member 506 through threaded connections 508 and 510, respectively. Additionally, depth reference coupling 502 includes an internal profile depicted as a circumferential slot or recess 512 having a lower surface 514 and an inclined or ramped upper surface 516. In this embodiment, lower surface 514 of recess 512 may have a slightly rounded or ramped surface.

Depth referencing assembly 500 also includes a second depth reference coupling 518 that connects or joins tubular member 520 and tubular member 522 through threaded connections 524 and 526, respectively. Additionally, depth reference coupling 518 includes an internal profile depicted as a circumferential slot or recess 528 having a square lower surface 530 and an inclined or ramped upper surface 532.

Depth referencing assembly 500 further includes a first indicator assembly depicted as indicator coupling 534 that connects or joins tubular member 536 through threaded connections 538 and a lower tubular member (not pictured). Indicator coupling 534 includes a mating profile depicted as collet assembly 540, which has a plurality of collet fingers 542 each including a head or protrusion 544 that is shaped and sized to engage with but pass through recess 512 of depth reference couplings 502 and engage with recess 528 of depth reference couplings 518.

Depth referencing assembly 500 additional includes a second indicator assembly depicted as indicator coupling 546 that connects or joins tubular member 548 through threaded connections 550 and an upper tubular member (not pictured). Indicator coupling 546 includes a mating profile depicted as collet assembly 552, which has a plurality of collet fingers 554 each including a head or protrusion 556 that is shaped and sized to engage with depth reference couplings 502.

In the illustrated embodiment, indicator coupling 534 first engages depth reference coupling 502 which causes a liner running weight response. At this point, the operator knows that the desired depth has almost been reached. As the lower surface 514 of recess 512 has a ramped surface, it may, for example, require only 10,000 pounds of additional weight to cause indicator coupling 534 to pass through depth reference coupling 502. Shortly thereafter, indicator coupling 534 engages depth reference coupling 518 and indicator coupling 546 engages depth reference coupling 502 which causes a significant liner running weight response. At this point, the operator knows that the desired depth has been reached.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A system for depth referencing and installing tubular strings in a wellbore, the system comprising:

a depth reference coupling positioned in a first tubular string installed in the wellbore, the first tubular string having a predetermined length between the depth reference coupling and a predetermined reference point, the depth reference coupling having a profile;

an indicator assembly positioned in a second tubular string, the indicator assembly having a mating profile operable to engage the profile of the depth reference coupling;

a service string releasably engageable with the second tubular string and operable to run the second tubular string in the first tubular string until the mating profile of the indicator assembly engages the profile of the depth reference coupling; and a suspension tool positioned in the second tubular string uphole of the indicator assembly, the suspension tool selectively operable to support the second tubular string within the first tubular string.

2. The system as recited in claim 1 wherein the depth reference coupling is operable to connect two adjacent tubular members of the first tubular string.

3. The system as recited in claim 1 wherein the indicator assembly further comprises an indicator coupling operable to connect two adjacent tubular members of the second tubular string.

4. A method for depth referencing tubular strings in a wellbore, the method comprising:

connecting two adjacent tubular members of a first tubular string with a depth reference coupling, the depth reference coupling having a profile;

installing the first tubular string in the wellbore;

determining the depth of the depth reference coupling relative to a predetermined reference point;

running a second tubular string in the first tubular string, the second tubular string having an indicator assembly positioned therein, the indicator assembly having a mating profile; and engaging the mating profile of the indicator assembly with the profile of the depth reference coupling.

5. The method as recited in claim 4 wherein determining the depth of the depth reference coupling relative to a predetermined reference point further comprises determining the depth of the depth reference coupling relative to a wellhead reference point.

6. The method as recited in claim 4 wherein determining the depth of the depth reference coupling relative to a predetermined reference point further comprises determining the depth of the depth reference coupling relative to a reference point in a third tubular string.

7. The method as recited in claim 4 wherein running a second tubular string in the first tubular string further comprises connecting two adjacent tubular members of the second tubular string with the indicator assembly.

8. The method as recited in claim 4 wherein engaging the mating profile of the indicator assembly with the profile of the depth reference coupling further comprises engaging a plurality of locating keys of the indicator assembly with the profile of the depth reference coupling.

9. The method as recited in claim 4 wherein engaging the mating profile of the indicator assembly with the profile of the depth reference coupling further comprises engaging a collet assembly of the indicator assembly with the profile of the depth reference coupling.

10. A system for depth referencing and installing tubular strings in a wellbore, the system comprising:

a depth reference coupling positioned in a first tubular string installed in the wellbore, the first tubular string having a predetermined length between the depth reference coupling and a predetermined reference point, the depth reference coupling having a profile;

an indicator assembly positioned in a second tubular string, the indicator assembly having a mating profile operable to engage the profile of the depth reference coupling;

a service string releasably engageable with the second tubular string and operable to run the second tubular string in the first tubular string until the mating profile of the indicator assembly engages the profile of the depth reference coupling; and a suspension tool positioned in the second tubular string downhole of the indicator assembly, the suspension tool selectively operable to support the second tubular string within the first tubular string.

11. The system as recited in claim 10 wherein the indicator assembly is retrievable with the service string assembly once the suspension tool has been actuated.

12. The system as recited in claim 10 wherein the depth reference coupling is operable to connect two adjacent tubular members of the first tubular string.

13. The system as recited in claim 10 wherein the indicator assembly further comprises an indicator coupling operable to connect two adjacent tubular members of the second tubular string.

* * * * *